US009125470B2

(12) United States Patent
Thiebaut et al.

(10) Patent No.: US 9,125,470 B2
(45) Date of Patent: Sep. 8, 2015

(54) DEVICE FOR APPLYING A COSMETIC PRODUCT WITH A ROTARY APPLICATOR

(75) Inventors: Laure Thiebaut, Clichy (FR); Nicolas Albisetti, Saint Gratien (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 14/344,187

(22) PCT Filed: Sep. 11, 2012

(86) PCT No.: PCT/EP2012/067734

§ 371 (c)(1),
(2), (4) Date: Jun. 20, 2014

(87) PCT Pub. No.: WO2013/037772

PCT Pub. Date: Mar. 21, 2013

(65) Prior Publication Data

US 2014/0356045 A1 Dec. 4, 2014

(30) Foreign Application Priority Data

Sep. 14, 2011 (FR) ..... 11 58177

(51) Int. Cl.
*A45D 34/04* (2006.01)
*A45D 40/26* (2006.01)

(52) U.S. Cl.
CPC ..... *A45D 34/042* (2013.01); *A45D 34/04* (2013.01); *A45D 40/26* (2013.01); *A45D 2200/056* (2013.01)

(58) Field of Classification Search
CPC .. B05C 17/02; B05C 17/0242; B05C 17/025; B05C 17/03; B05C 17/0308; B05C 17/0316; B05C 17/0325; A45D 34/04; A45D 34/041; A45D 40/26; A45D 40/261; A45D 34/042; A45D 2200/056
See application file for complete search history.

(56) References Cited

U.S. PATENT DOCUMENTS

| | | | | |
|---|---|---|---|---|
| 4,648,732 | A * | 3/1987 | Smialkowski | 401/196 |
| 4,747,720 | A * | 5/1988 | Bellehumeur et al. | 401/205 |
| 6,099,186 | A | 8/2000 | Lye | |
| 8,602,671 | B2 * | 12/2013 | Kim | 401/219 |

FOREIGN PATENT DOCUMENTS

| | | | |
|---|---|---|---|
| EP | 0174663 | A2 | 3/1986 |
| FR | 2912882 | A1 | 8/2008 |
| WO | WO-2009/128571 | A1 | 10/2009 |

* cited by examiner

*Primary Examiner* — David Walczak
(74) *Attorney, Agent, or Firm* — Novak Druce Connolly Bove + Quigg LLP

(57) ABSTRACT

A device for applying a cosmetic product comprising a reserve (3) of cosmetic product; a support and distribution member (5) connected to the reserve, the support and distribution member having a cosmetic product distribution opening (7) communicating with the reserve; a rotary applicator member (11) having a hub (13) rotatably mounted on the support and distribution member around a longitudinal axis (X), and a porous applicator (15) arranged around the hub. The hub comprises at least one inner channel (67) for distributing the cosmetic product communicating with the distribution opening, the inner channel having at least one outlet opening (77, 79) emerging on an outer surface (73) of the hub covered by the porous applicator, the porous applicator having a first total longitudinal length, the outer surface of the hub having a second total longitudinal length greater than 75% of the first total longitudinal length.

20 Claims, 4 Drawing Sheets

DEVICE FOR APPLYING A COSMETIC PRODUCT WITH A ROTARY APPLICATOR

CROSS REFERENCE TO RELATED APPLICATIONS

This application is a National Phase filing under 35 U.S.C. §371 of PCT/EP2012/067734 filed on Sep. 11, 2012; and this application claims priority to Application No. 1158177 filed in France on Sep. 14, 2011 under 35 U.S.C. §119; the entire contents of all are hereby incorporated by reference.

The present invention generally relates to devices for applying cosmetic products, with a rotary applicator member.

More specifically, the invention relates to a device for applying a cosmetic product, the device being of the type comprising:

a reserve of cosmetic product;

a support and distribution member connected to the reserve, the support and distribution member having a cosmetic product distribution opening communicating with the reserve;

a rotary applicator member having a hub rotatably mounted on the support and distribution member around a longitudinal axis, and a porous applicator arranged around the hub.

A device of this type is known from FR 2848790. The hub is snapped around the support member. The porous applicator is a foam block having a blind housing, in which the hub is engaged.

The grid is arranged in the foam, so as to facilitate the regular diffusion of the cosmetic product in the porous applicator.

In such an application device, the diffusion of the cosmetic product from the distribution opening to the free surface of the porous applicator is long. Thus, when the user wishes to apply the cosmetic product, the first turn of the applicator member is done dry, and a complete revolution may for example be necessary before the entire outer surface of the porous applicator is impregnated with the cosmetic product.

In this context, the invention aims to propose an applicator device that is easier to use.

To that end, the invention relates to applicator device of the aforementioned type, characterized in that the hub comprises at least one inner channel for distributing the cosmetic product communicating with the distribution opening, the inner channel having at least one outlet opening emerging on an outer surface of the hub covered by the porous applicator, the porous applicator having a first total longitudinal length, the outer surface of the hub covered by the porous applicator having a second total longitudinal length greater than 75% of the first total longitudinal length.

Thus, the cosmetic product circulates from the distribution opening through the inner channel and the outlet opening as far as the outer surface of the hub. It is distributed over the outer surface of the hub and from there, diffuses into the mass of the porous applicator, up to the free surface of that applicator. The flow of the cosmetic product from the outer surface of the hub is faster than the diffusion of the cosmetic product through the pores of the porous applicator. Because the outer surface of the hub has a total longitudinal length greater than 75% of the total longitudinal length of the porous applicator, the cosmetic product is therefore longitudinally distributed quickly along the porous applicator. The diffusion of the cosmetic product in the porous applicator up to the free surface thereof is therefore accelerated.

Because the cosmetic product diffuses rapidly through the entire porous applicator up to the free surface thereof, the application of the cosmetic product on the skin is more uniform.

The cosmetic product is a product as defined in EEC guideline 93/35 by the Council dated Jun. 14, 1993.

The cosmetic product is a fluid product, for example a liquid or cream or paste. This product is a makeup or face, skin, or hair care product. This product may be an anti-wrinkle product, a product for dark rings, a mascara, a gloss, etc.

"Total longitudinal length" of the porous applicator refers to the dimension of the porous applicator mounted on the hub, considered in the longitudinal direction.

"Outer surface covered by the porous applicator" refers to the assembly of the outer surface of the hub against which the porous applicator is applied or from which the porous applicator separated by a small space (for example, less than 1 mm).

The outlet opening emerges axially on the inner surface, or laterally.

For example, the second longitudinal length is comprised between 80% and 95% of the first longitudinal length, preferably between 85 and 90% of the first longitudinal length. The first and second longitudinal lengths are symbolized by references $L_A$ and $L_M$ in FIG. 2.

The inner distribution channel of the hub typically extends along the longitudinal axis of rotation, and is typically arranged at the center of the hub. Alternatively, the hub comprises several internal channels, each communicating with the distribution opening and each emerging through at least one outlet opening on the outer surface of the hub.

Typically, the porous applicator has a first longitudinal end turned toward the reserve and a second longitudinal end opposite the first, at least one outlet opening being situated at a longitudinal distance from the second longitudinal end smaller than 25% of the first total longitudinal length. This distance is symbolized by reference d in FIG. 2.

The longitudinal distance of the outlet opening in relation to the second end of the applicator is taken at the edge of the outlet opening, and more specifically at the area of the edge of the outlet opening closest to said end.

Preferably, the longitudinal distance separating the outlet opening from the end is comprised between 5 and 20% of the total longitudinal length of the porous applicator, still more preferably between 10 and 15% of said longitudinal length.

Typically, the hub includes several outlet openings, distributed circumferentially around the longitudinal axis. These outlet openings are for example regularly circumferentially spaced around the longitudinal axis. Thus, the entire periphery of the porous applicator is homogenously imbibed.

The hub for example includes between 4 and 8 outlet openings, for example 6 outlet openings.

Advantageously, the outer surface of the hub has protruding and/or hollow reliefs to facilitate the flow of the cosmetic product on the outer surface. The protruding reliefs define passages between them facilitating the flow of the cosmetic product between the outer surface of the hub and the porous applicator. The hollow portions play the same role. Preferably, the reliefs are distributed over the entire outer surface covered by the porous applicator.

The protruding reliefs may assume any shapes adapted to form a distribution grid between them for the cosmetic product. The hollow reliefs may also have any shapes and preferably form a network of distribution channels for the cosmetic product.

Advantageously, the outer surface of the hub has several longitudinal grooves, each outlet emerging in a groove. The grooves are provided in addition to or at the location of the aforementioned reliefs. The grooves facilitate the flow of the cosmetic product axially along the outer surface. From the opening, the cosmetic product flows in the groove toward both of the two longitudinal ends of the porous applicator. The cosmetic product diffuses through the porous applicator from the grooves. The grooves are preferably regularly distributed around the longitudinal axis. These grooves considerably accelerate the diffusion of the cosmetic product to the free surface of the porous applicator.

Alternatively, the grooves are not longitudinal. They are for example helical around the X axis, or winding, or have any other shape adapted to facilitate the distribution of the cosmetic product on the outer surface of the hub.

Typically, each outlet opening has a longitudinal length comprised between 5% and 75% of the total longitudinal length of the porous applicator. The longitudinal length of one of the openings is symbolized by reference $L_O$ in FIG. 2.

The very long openings facilitate the distribution of the cosmetic product axially along the porous applicator. The short openings make it possible to impart better rigidity to the hub.

Preferably, the outlet openings are in the shape of slits, and have a small width in relation to their longitudinal length. This is particularly advantageous when the outlet openings emerge in grooves hollowed in the outer surface of the hub. The joint use of grooves and outlet openings in the shape of slits allows particularly quick distribution of the cosmetic product over the entire length of the hub, and effective diffusion over the entire free surface of the porous applicator.

Typically, the inner channel has at least two outlet openings having different respective longitudinal lengths. In that case, the outlet openings are advantageously longitudinally stepped. This means that some outlet openings extend longitudinally beyond other outlet openings.

It is thus possible to vary the passage section offered to the cosmetic product through the outlet openings, longitudinally. For example, near one end of the porous applicator, the passage section offered to the cosmetic product is smaller. On the other hand, at the center of the porous applicator, the passage section offered to the cosmetic product is relatively larger. For the other end, the passage section offered to the cosmetic product becomes smaller again.

In this way, it is possible to modulate the passage section for the cosmetic product as a function of the shape of the hub.

If the hub has a generally cylindrical shape, one will for example provide a slightly larger passage section at the central longitudinal area of the hub, and relatively smaller at the two longitudinal ends of the hub. If the hub has a tapered shape that narrows toward the first end of the porous applicator, a smaller passage section will be provided at the narrow end of the hub, since the surface of the porous applicator to be imbibed is also smaller.

As indicated above, the porous applicator preferably covers part of the hub with a tapered or cylindrical or ovoid or substantially barrel-shaped shape. These shapes are well adapted to causing the applicator member to roll all over the user's skin.

Preferably, the porous applicator has a thickness comprised between 1 and 5 mm. "Thickness of the porous applicator" refers to the material thickness separating the outer surface of the hub from the free surface of the porous applicator. This material thickness is in the above range at all points of the porous applicator. Such a thickness makes it possible to limit the build-up of cosmetic product of the porous applicator.

Preferably, the applicator member is hollow. In other words, the applicator member delimits an inner volume in which the hub is engaged. In this way, the thickness of porous material separating the outer surface of the hub from the free surface of the applicator member is relatively small. This facilitates a regular and quick diffusion of the cosmetic product from the external surface of the hub to the free surface.

Typically, the applicator member is a sock slid around the hub. This means that the applicator member assumes the shape of a bag or pouch, with an opening making it possible to insert the hub inside the applicator member. Typically, the applicator member is made from a material having a certain elasticity. In that case, the part of the hub slid inside the applicator member typically has a maximum section, considered perpendicular to the longitudinal direction, greater than the passage section of the insertion opening. The applicator member is thus maintained around the hub through elasticity.

Alternatively, the porous applicator is attached to the hub by a weld, for example a ring weld. This ring weld is for example done around the edge of the insertion opening.

According to another alternative embodiment, the porous applicator is fastened to the hub by a locking ring, which pinches the porous applicator against the hub. For example, the ring is snapped on the hub.

The porous applicator is for example made from foam, or a flocked plastic material, or a sintered or felt material, or a fibrous material.

In any case, the porous applicator is made from a material adapted to allow the diffusion of the cosmetic product from the opening(s) of the inner channel to the free surface of the porous applicator.

The reserve is for example a bottle, tube, pot, or other type of container. It contains the cosmetic product. In one alternative embodiment, the support and distribution member is directly connected to the reserve through any suitable means: screwing, welding, clipping, etc. According to another alternative, the support and distribution member is integrated into a mechanism making it possible to transfer the cosmetic product from the reserve to the distribution opening.

The cosmetic product distribution opening formed on the support communicates with the reserve typically through a duct. For example, the reserve has a deformable side wall, and the user manually presses on the wall of the reserve to supply the applicator member with cosmetic product. This leads to a reduction in the inner volume of the reserve, which drives part of the cosmetic product to the distribution opening, and from there into the applicator member.

Alternatively, the support member includes a valve inserted in the duct and opening under the pressure of the cosmetic product.

According to one alternative, the transfer mechanism includes a manual pump. When the user actuates the pump, a dose of cosmetic product is suctioned in the reserve and discharged through the distribution opening into the applicator member. In another alternative, the transfer mechanism comprises a piston.

The hub is rotatably mounted on the support and distribution member using any adapted means. For example, the hub is clipped around part of the support and distribution member forming a pivot. Alternatively, the hub includes two half-bodies assembled to each other around said part forming the pivot.

In one alternative embodiment, the hub includes:

a base connected to the support and distribution member;

a grid in which several outlet openings are formed, the grid being inserted between the base and the porous applicator and being connected to the base;

the inner distribution channels for the cosmetic product delimited between the base and the grid for the cosmetic product.

Such a structure allows a uniform distribution of the cosmetic product on the outer surface of the hub. In particular, the hub may include multiple inner channels regularly distributed around hubs, and multiple openings distributed in the grid.

Preferably, the different outlet openings have limited sizes and are distributed uniformly in the grid. This grid defines the outer surface of the hub.

The grid and the base are preferably two separate parts and assembled to one another, using any adapted means. The distribution channels are thus very easily made.

Other features and advantages of the invention will emerge from the following detailed description provided below, for information and non-limitingly, in reference to the appended figures, in which.

Figure 1:
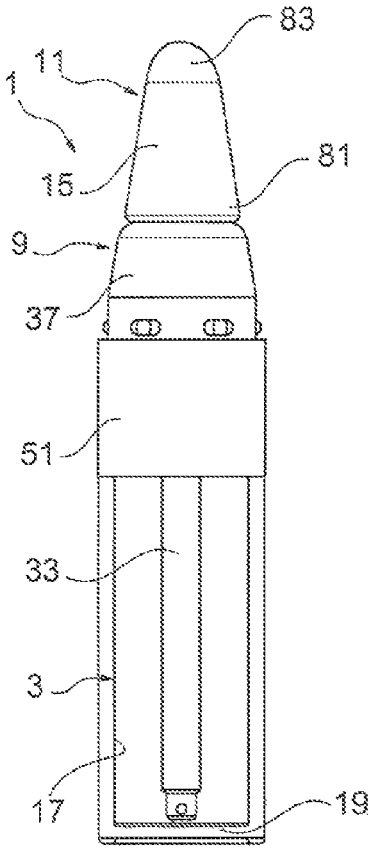
FIG. 1 is a side view of an applicator device according to the invention, the inside of the cosmetic product reserve being shown transparently through the wall of said reserve.
Figure 3:
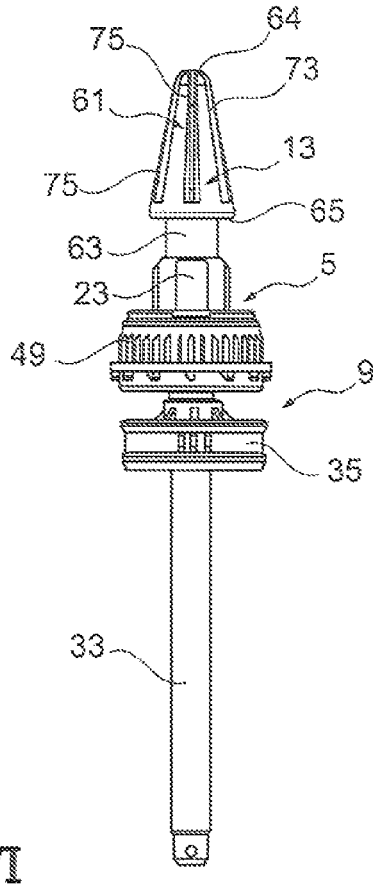
FIG. 3 is a side view of certain internal elements of the device of FIG. 1.
Figure 4:
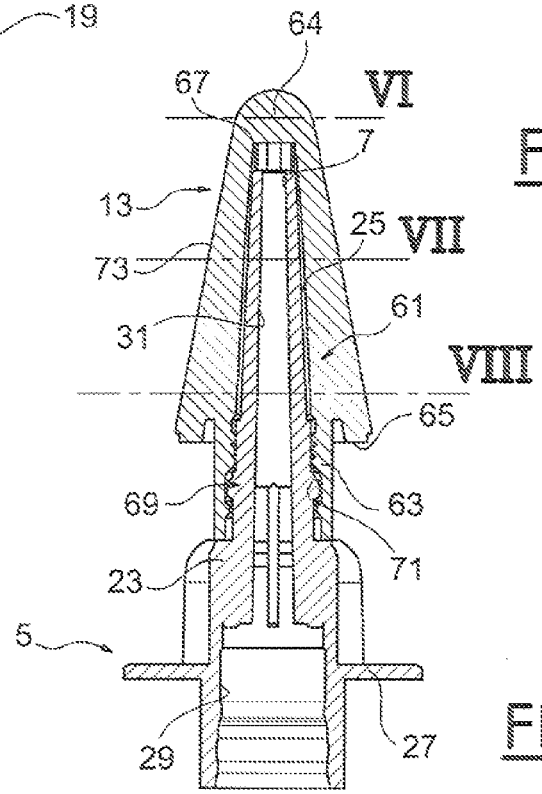
FIG. 4 is an axial cross-sectional view of the support and distribution member and the hub of FIG. 3.

The device 1 shown in FIG. 1 is designed for the application of the fluid cosmetic product.

Figure 2:
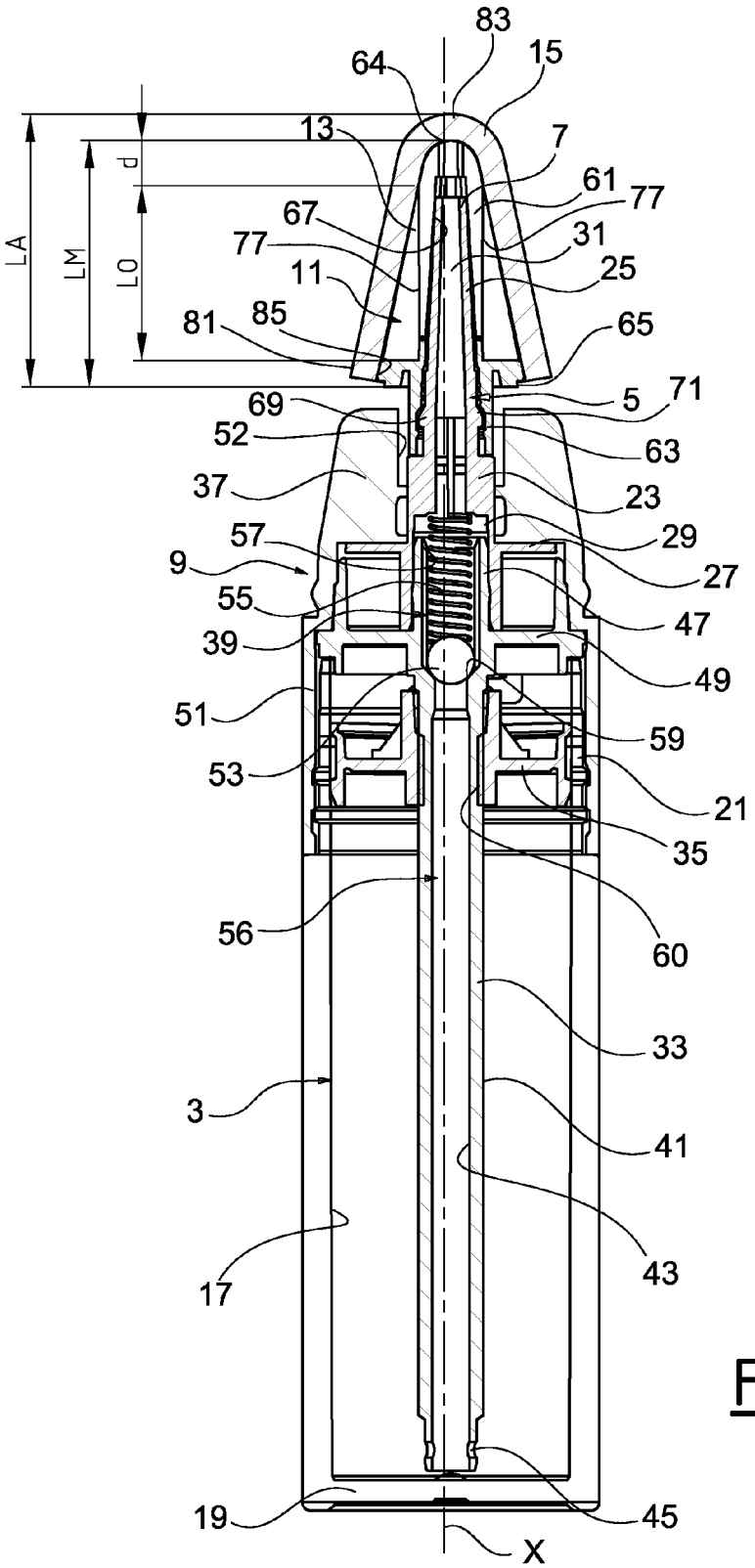
FIG. 2 is an axial cross-sectional view of the device of FIG. 1.
Figure 5:
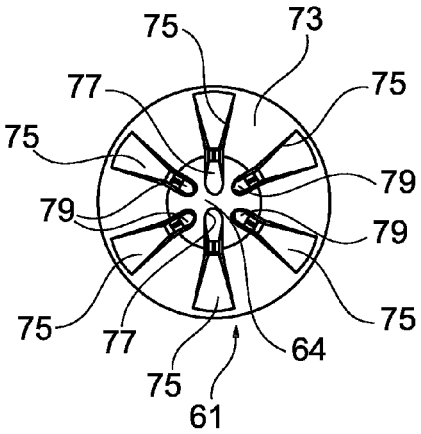
FIG. 5 is a top view of the hub of FIG. 4.
Figure 6:
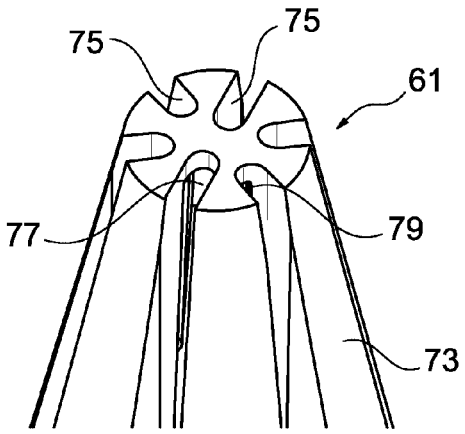
FIGS. 6 to 8 are perspective views of the hub of FIG. 4, cut along planes VI to VIII shown in FIG. 4.
Figure 7:
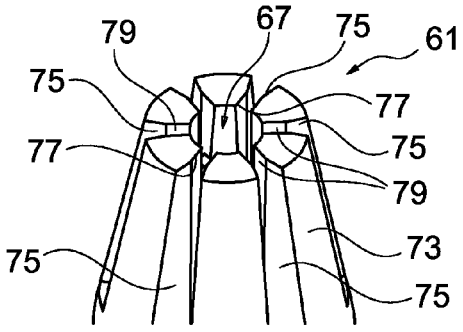
Figure 8:
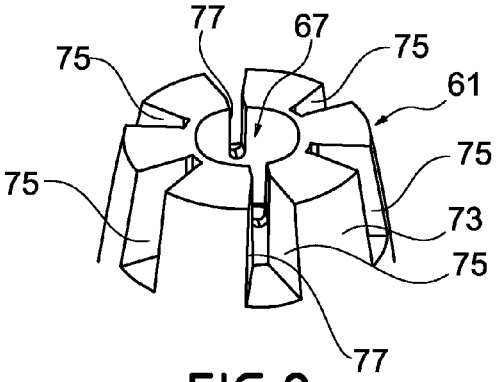

As shown in FIGS. 1 and 2, the applicator device comprises:

a reserve 3 of cosmetic product;

a support and distribution member 5 connected to the reserve 3, having an opening 7 for distributing a cosmetic product communicating with the reserve 3;

a mechanism 9 for transferring the cosmetic product from the reserve 3 to the distribution opening 7;

a rotary applicator member 11 having a hub 13 rotatably mounted on the support and distribution member 5 and a porous applicator 15 arranged around the hub.

The reserve 3 delimits an inner volume 17 containing the fluid cosmetic product. It has a flat bottom 19. The device can thus be arranged in an upright position, the flat bottom then resting on a support surface.

Opposite the bottom 19, the reserve 3 has a neck 21 defining an access opening to the internal volume. The reserve 3 is elongated along a longitudinal axis X substantially perpendicular to the bottom 19.

The support and distribution member 5 comprises a central body 23, a support portion 25 for the applicator member 11, which is substantially tapered, and a peripheral flange 27. The central body includes a blind housing 29, opened toward the reserve 3, the function of which will be described later. The support portion 25 axially extends the body 23 opposite the reserve. It forms a pivot for guiding the rotation of the applicator member 11. The member 5 includes an inner circulation channel for the cosmetic product 31 extending from the bottom of the blind housing 29, longitudinally to the end of the portion 25. The end of the circulation channel 31 constitutes the distribution opening 7 of the cosmetic product. The flange 27 extends radially toward the outside from the central body 23 and is substantially perpendicular to the axis X.

The mechanism 9 comprises a tube 33 for distributing the cosmetic product, a piston 35 arranged in the inner volume 17 and axially movable along the tube 33, a control ring 37 rotatably mounted on the reserve 3, and a seal 39. The tube 33 extends along the longitudinal axis X of the reserve. It has a thread on its outer surface 41. It inwardly defines a passage 43 for transferring the cosmetic product from the inner volume 17 to the inner channel 31.

The tube 33 has a first open end 45, arranged near the bottom 19 of the reserve. The cosmetic product is free to penetrate the inner passage 43 through the open end 45. The second end 47 of the tube is forcibly engaged in the blind housing 29. The second end 47 is also open, such that the cosmetic product leaving the passage 43 can penetrate the circulation channel 31. The tube 33 bears, near the end 47, a flange 49 extending radially toward the outside from the tube 33. The flange 49 is rigidly fastened to the control ring 37.

The ring 37 rotates freely around the longitudinal axis X in relation to the reserve 3. It is, however, axially locked in relation to the reserve 3. To that end, the ring 37 includes a hoop 51 arranged around the neck 21 of the reserve. The hoop 51 inwardly includes a plurality of circumferential hollow grooves, in which circumferential ribs are engaged formed on an outer surface of the neck 21. The ring 37 includes, along the longitudinal axis X, an opening 52 passed through by the support and distribution member 5. The support portion 25 protrudes axially outside the opening 52 opposite the reserve, and the central body 23 protrudes outside the opening 52 axially toward the reserve 3.

Thus, the ring 37, the tube 33 and the support and distribution member 5 form a subassembly rotatable as a single piece around the axis X in relation to the reserve 3.

The seal 39 includes a bead 53 and a return spring 55. The passage 43 of the tube 33 has a segment with a reduced inner diameter 56, extended by a segment with a relatively larger inner diameter 57. The segment 57 is situated at the end 47 engaged in the blind housing 29. The shoulder 59 connecting the two segments forms a sealing step against which the bead 53 bears. The return spring 55 is for example a spiral spring with axis X, compressed between the bead 53 on the one hand and the bottom of the blind housing 29 on the other hand.

The piston 35 includes a central opening 60 with an inner tapping, cooperating with the outer thread of the tube 33. Perpendicular to the axis X, it has an outer section complementary to the inner section of the volume 17. Its radially outer portion bears means making it possible to establish sealing with the wall of the reserve 3.

The hub 13 comprises a substantially tapered portion 61 covered by the porous applicator 15, and a portion 63 provided for rotatable mounting on the support and distribution member.

The tapered portion 61 is coaxial to the axis X, and has a section that decreases as it moves axially away from the reserve 3. It has a rounded tip 64 opposite the reserve 3. The portion 63 longitudinally extends the portion 61 toward the reserve. The portion 63 is substantially cylindrical, and has a reduced outer diameter in relation to the base of the tapered portion 61. A shoulder 65 thus connects the portions 61 and 63 to each other.

The hub 13 includes a central inner channel 67, extending along the axis X. This channel is axially open toward the reserve 3. The support portion 25 is engaged inside the channel 67. It passes all the way through the cylindrical portion 63. The outer tapered surface of the portion 25 cooperates with an inner tapered surface of the channel 67 to guide the rotation of the hub around the axis X in relation to the support and distribution member.

The support portion 25 bears, at the cylindrical portion 63, protruding reliefs 69 engaged in a circumferential hollow groove 71 hollowed in the inner surface of the portion 63. The protruding portion 69 cooperates with the hollow groove 71 to lock the hub axially in relation to the support and distribution member, while allowing rotational travel of the hub 13 around the portion 25.

The distribution opening 7 emerges in the inner channel 67, near the tip 64 of the hub.

As visible in particular in FIGS. 3 and 5 to 8, the hub has, on a substantially tapered outer surface 73, a plurality of hollow grooves 75 oriented longitudinally. The grooves 75 are regularly distributed around the axis X. In the illustrated example, the hub 13 includes six grooves 75. The grooves 75 each extend over the majority of the longitudinal length of the hub. More specifically, they extend over nearly all of the longitudinal length of the hub.

Each groove 75 is longitudinally open on the side of the tip 64 and closed toward the reserve 3. The reserves are substantially rectilinear.

Furthermore, the inner channel 67 has a plurality of outlet openings 77, 79 emerging on the outer surface 73 of the hub. The outlet openings 77, 79 allow the cosmetic product to flow from the inner channel 67 on the outer surface 73, in an area covered by the porous applicator 15.

In the example embodiment shown in FIGS. 5 to 8, the outlet openings 77, 79 emerge in the bottom of the grooves 75. The outlet openings 77, 79 assume the form of longitudinally oriented slits. Two slits referenced 77 extend over approximately 75% of the total longitudinal length of the porous applicator. The length of the slit 77 and the total longitudinal length of the applicator are respectively marked $L_O$ and $L_A$ in FIG. 2. Four other slits, referenced 79, have a longitudinal length of approximately 50% of the total longitudinal length $L_A$ of the porous applicator. The two slits 77 open in two diametrically opposite grooves 75 in relation to the axis X.

The respective ends of the slits 77 situated toward the tip 64 of the hub are situated, in relation to the end 83 of the porous applicator covering said tip 64, at a longitudinal distance of approximately 15% of the total longitudinal length of the porous applicator (d in FIG. 2). Toward the reserve, each slit 77 extends to the closed end of the corresponding groove 75.

The respective ends of the slits 79 turned toward the tip 64 of the hub are situated, in relation to the end 83 of the porous applicator, at a longitudinal distance of approximately 30% of the total longitudinal length of the porous applicator. The ends of the slits 79 turned toward the reserves stop at a distance away from the closed ends of the corresponding grooves.

The porous applicator 15 is a hollow element with a generally tapered shape. It thus has a first longitudinal end 81, toward the reserve 3, and a second longitudinal end 83, opposite the reserve 3. The end 81 corresponds to the base of the frustum and the end 83 to its tip. The base 81 has an opening 85 through which the portion 61 of the support member is engaged inside the porous applicator.

The porous applicator 15 is made from an open cell plastic foam. The plastic material is typically MBR, SBR, PDU, cellulose, polyester, polyethylene, or any other type of adaptive material.

The porous applicator 15 is thus made from a plastic material. It inwardly defines a volume with a shape generally corresponding substantially to the shape of the portion 61, but with a size slightly smaller than the size of the portion 61. Thus, when the porous applicator is slipped around the portion 61, said porous applicator is elastically retained against the outer tapered surface 73 of the portion 61.

Furthermore, the applicator device includes a cover (not shown), designed to cover the porous applicator 15. The cover clips around the ring 37. The cover is for example pierced to allow aeration of the porous applicator.

The operation of the applicator device according to the invention will now be outlined.

When the user wishes to apply the cosmetic product, she first separates the cover from the ring 37, then turns the ring 37 manually around the axis X in relation to the reserve 3. The ring 37 rotates the tube 33. The user chooses the direction of rotation so as to move the piston 35 toward the bottom 19 of the reserve, by means of the threading of the tube cooperating with the tapping of the piston 35.

The movement of the piston results in pressurizing the cosmetic product housed in the inner volume 17, the latter being driven through the inner passage 43 of the tube. When the pressure is strong enough to overcome the return force of the spring 55, the bead 53 lifts from the seat 59 and the cosmetic product can flow from the inner passage 43 into the channel 31.

The cosmetic product flows along the channel 31 up to the distribution opening 7.

It exits through the distribution opening 7 and flows through the outlet openings 77, 79 into the grooves 75.

The cosmetic product penetrates the grooves 75 at points of those grooves situated near the tip 64 of the hub, since the distribution opening 7 is situated not far from the tip 64. The cosmetic product then descends along the grooves 75 toward the closed ends of the grooves.

The cosmetic product is thus distributed over the entire outer surface 73 of the hub. From that outer surface 73, the cosmetic product imbibes the porous applicator through capillarity, through the open cells of said porous applicator. The distance to be traveled by the cosmetic product to arrive at the free surface of the porous applicator starting from the outer surface 73 is short, since the porous applicator has a small thickness, comprised between 1 and 5 mm. The user then rolls the porous applicator on her skin around the longitudinal axis X. The cosmetic product is deposited almost immediately on the users skin, after a rotation corresponding to only a fraction of a revolution. This is explained by the fact that the distance to be traveled by the cosmetic product to be diffused on the outer surface 73 of the hub to the free surface of the porous applicator is extremely short.

In one alternative not shown, the outlet openings of the inner channel are not longitudinally elongated slits. The outlet openings are holes with a small longitudinal length with respect to the longitudinal length of the grooves 75. For example, each outlet opening has a longitudinal length comprised between 0.5 and 5% of the total longitudinal length of the porous applicator. This opening is, however, situated at a longitudinal distance of less than 25% of the total longitudinal length of the porous applicator, in relation to the distal end of the porous applicator.

One alternative embodiment of the invention will now be described, in reference to FIGS. 9 to 11. Only the points in which this alternative embodiment differs from that described in reference to FIGS. 1 to 8 will be outlined below.

Identical elements or elements performing the same function will be designated using the same references.

Figure 9:
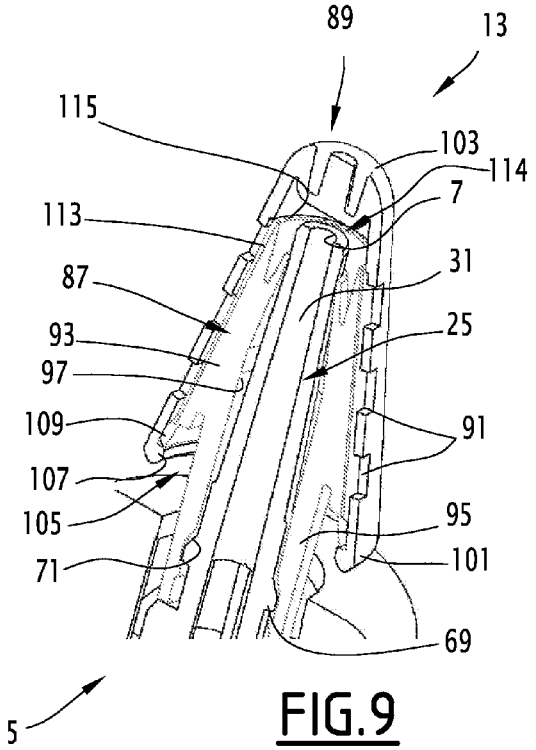
FIG. 9 is a cross-sectional perspective view of the support and distribution member and an alternative embodiment of the hub in which said hub is made up of the base and the grid.
Figure 10:
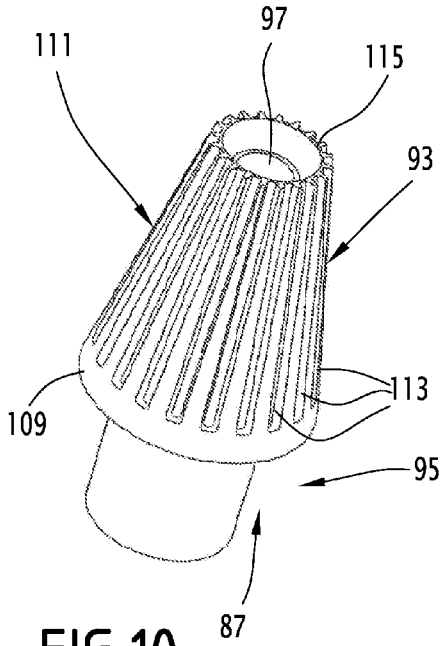
FIGS. 10 and 11 are perspective views of the grid and the base of the hub of FIG. 9.
Figure 11:
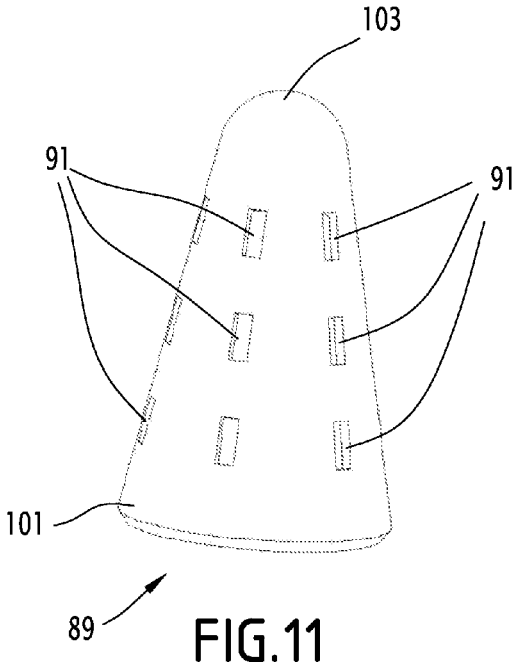

The applicator device partially shown in FIGS. 9 to 11 only differs from that shown in FIGS. 1 to 8 by its hub. In FIGS. 9 to 11, the hub is made in two parts. It includes:

a base 87 connected to the support portion 25 of the support and distribution member 5;

a grid 89 in which several outlet openings 91 are formed, the grid 89 being inserted between the base 87 and the porous applicator 15 and being connected to the base 87.

The base 87 has a shape generally close to that of the hub of FIGS. 1 to 8. More specifically, it includes a substantially tapered portion 93, and a portion 95 provided for rotatable mounting on the support and distribution member.

The tapered portion 93 is coaxial to the axis X and has a section that decreases as it moves axially away from the reserve 3. The portion 95 extends the portion 93 toward the reserve. It is substantially cylindrical and has a reduced outer diameter in relation to the base of the tapered portion 93.

The hub of FIGS. 9 to 11 includes several inner channels for distributing the cosmetic product, putting the distribution opening 7 in communication with the element openings 91. These channels are delimited between the grid 89 and the base 87.

However, the base 87 has an axial central passage 97 provided only for the rotatable mounting of the hub on the support portion 25. The central passage 97 extends over the entire length of the base 87 and passes completely through the base 87. It is open at those two axial ends.

The support portion 25 is engaged in the central channel 97, its free end extending beyond the latter. Thus, the distribution opening protrudes beyond the passage 97, and does not emerge inside that passage, as visible in FIG. 9.

However, the outer tapered surface of the portion 25 cooperates with the inner surface of the passage 97 to guide the hub in rotation around the axis X in relation to the support and distribution member 5. The cylindrical portion 95 inwardly has a circumferential hollow groove 71, cooperating with protruding reliefs 69 of the support portion 25, so as to axially lock the base 87 in relation to the support and distribution member, while allowing rotational travel.

The grid 89 has a generally tapered shape, and fits the tapered portion 93 of the base. More specifically, it has a section that narrows axially from the base portion 101 to a rounded tip 103. The openings 91 are formed in the side wall of the grid. The base portion 101 has an opening 105, for the insertion of the tapered portion 93 of the base. The opening 105 is delimited by an inner bead 107 protruding toward the inside of the grid. The inner volume delimited by the grid has a shape conjugated with that of the tapered portion 93 of the base. When the tapered portion 93 is engaged inside the grid 89, the shoulder 109 situated at the junction between the portions 93 and 95 bears on the bead 107. The tapered outer surface 111 of the portion 93 bears against the inner surface of the grid. The tapered portion 93 of the hub is thus locked inside the grid.

The outer tapered surface 111 has a plurality of hollow grooves 113 oriented substantially longitudinally. The grooves 113 are substantially parallel to each other and are regularly distributed around the axis X. They are close to the respective ends turned toward the reserve, but emerge at their opposite ends.

As shown in FIG. 9, the distribution opening 7 emerges in a volume 114 delimited between the tip 103 of the grid and the end 115 of the tapered portion 93 with the smallest section. The open ends of the grooves 113 also emerge in the volume. Thus, the grooves 113 define inner channels for distributing the cosmetic product putting the distribution opening 7 in communication with the different outlet openings 91 of the grid.

The porous applicator 15 is applied on the grid 89, that grid thereby delimiting the outer surface of the hub.

The invention claimed is:

1. A device for applying a cosmetic product, the device comprising:

a reserve for containing the of cosmetic product;

a support and distribution member connected to the reserve, the support and distribution member having at an end a cosmetic product distribution opening communicating with the reserve;

a rotary applicator member having a hub rotatably mounted around the support and distribution member around a longitudinal axis (X), and a porous applicator arranged around the hub;

wherein the hub comprises at least one inner channel for distributing the cosmetic product communicating with the distribution opening, the inner channel having at least one outlet opening emerging on an outer surface of the hub covered by the porous applicator, the porous applicator having a first total longitudinal length, the outer surface of the hub having a second total longitudinal length greater than 75% of the first total longitudinal length, the outer surface of the hub having protruding and/or hollow reliefs to facilitate the flow of the cosmetic product on the outer surface.

2. The device according to claim 1, wherein the porous applicator has a first longitudinal end turned toward the reserve and a second longitudinal end opposite the first, the at least one outlet opening being situated at a longitudinal distance from the second longitudinal end smaller than 25% of the first total longitudinal length.

3. The device according to claim 2, wherein the hub includes several outlet openings, distributed circumferentially around the longitudinal axis (X).

4. The device according to claim 2, wherein the outer surface of the hub has protruding and/or hollow reliefs to facilitate the flow of the cosmetic product on the outer surface.

5. The device according to claim 2, wherein the outer surface of the hub has several longitudinal grooves, each outlet emerging in a groove.

6. The device according to claim 2, wherein each outlet opening has a longitudinal length comprised between 5% and 75% of the total longitudinal length of the porous applicator.

7. The device according to claim 1, wherein the hub includes several outlet openings, distributed circumferentially around the longitudinal axis (X).

8. The device according to claim 7, wherein the outer surface of the hub has protruding and/or hollow reliefs to facilitate the flow of the cosmetic product on the outer surface.

9. The device according to claim 7, wherein the outer surface of the hub has several longitudinal grooves, each outlet emerging in a groove.

10. The device according to claim 7, wherein each outlet opening has a longitudinal length comprised between 5% and 75% of the total longitudinal length of the porous applicator.

11. The device according claim 1, wherein the outer surface of the hub has several longitudinal grooves, each outlet emerging in a groove.

12. The device according claim 1, wherein the at least one outlet opening has a longitudinal length comprised between 5% and 75% of the total longitudinal length of the porous applicator.

13. The device according to claim 1, wherein the at least one outlet opening comprise two outlet openings having different respective longitudinal lengths.

14. The device according claim 1, wherein the at least one outlet opening comprise two outlet openings that are longitudinally stepped.

15. The device according claim 1, wherein the porous applicator has a thickness comprised between 1 and 5 mm.

16. The device according claim 1, wherein the porous applicator covers part of the hub with a tapered or cylindrical or ovoid or substantially barrel-shaped shape.

17. The device according claim 1, wherein the porous applicator is made from foam, or a flocked plastic material, or a sintered or felt material, or a fibrous material.

18. The device according claim 1, wherein the hub includes:

a base connected to the support and distribution member;

a grid in which several outlet openings are formed, the grid being inserted between the base and the porous applicator and being connected to the base;

at least one an inner distribution channel for the cosmetic product being delimited between the base and the grid.

19. The device according to claim 1, wherein the outer surface of the hub has a part with a tapered or cylindrical or ovoid or substantially barrel-shape.

20. The device according to claim 1, wherein the protruding and/or hollow reliefs are distinct from the at least one outlet opening.

* * * * *